US005944061A

United States Patent [19]

Eriksson

[11] Patent Number: 5,944,061

[45] Date of Patent: Aug. 31, 1999

[54] DOBBY WITH CAM DRUM LEVER DRIVE

[75] Inventor: Äke Eriksson, Simpsonville, S.C.

[73] Assignee: Texo AB, Almhult, Sweden

[21] Appl. No.: 09/016,732

[22] Filed: Jan. 30, 1998

[30] Foreign Application Priority Data

Feb. 6, 1997 [SE] Sweden ..... 9700405

[51] Int. Cl.[6] ..... D03C 1/00

[52] U.S. Cl. ..... 139/66 R; 139/76

[58] Field of Search ..... 139/66 R, 76, 139/57, 79

[56] References Cited

U.S. PATENT DOCUMENTS 4,544,000 10/1985 Bourgeaux ..... 139/66 R
5,174,342 12/1992 Vinciguerra ..... 139/76
5,209,270 5/1993 Vincguerra ..... 139/76
5,259,419 11/1993 Vinciguerra et al. ..... 139/66 R
5,309,949 5/1994 Tremer ..... 139/79
5,479,964 1/1996 Burigana ..... 139/76

*Primary Examiner*—Andy Falik
*Attorney, Agent, or Firm*—Pollock, Vande Sande & Amernick

[57] ABSTRACT

A dobby for controlling movements of a heald frame in a weaving machine is provided. A treadle is mounted on a treadle spindle and a link arrangement connects the treadle to the heald frame. Levers are mounted on the treadle and catching members are arranged on the levers and on the treadle. The catching members on the treadle interact with a corresponding catching member on one of the levers based on a control signal. Driving equipment moves the levers between a central position and an outer position. The treadle follows the movements of the lever it is connected to by the catching members and moves the heald frame via the link arrangement.

28 Claims, 8 Drawing Sheets

DOBBY WITH CAM DRUM LEVER DRIVE

FIELD OF THE INVENTION

The present invention relates to a dobby for controlling the movements of the heald frames in a weaving machine between different positions, for example between upper, lower and closed shed positions. The dobby comprises treadles which are assigned to the various heald frames and can be movable by means of drive equipment. When the drive equipment performs its action, the treadles move to different positions depending upon the controlled interaction between mutually interconnectable catching members which operate with one or more lifters and one or more knife elements. Each treadle is mounted on a treadle spindle and acts on its assigned heald frame via a link arrangement.

BACKGROUND OF THE INVENTION

A great many dobbies are previously known. The dobby can serve as a module in the weaving machine and individual weaving machines can be provided with different types of dobbies. For example U.S. Pat. No. 5,309,949, it is previously known to use of lifters and knives in order to control the movements of the treadles in a dobby. The prior art uses a knife arrangement which is mounted in a stand, in which rotatable drums are arranged. The knives are provided with pins at their ends, which are guided in grooves on the drums so that, during the coordinated rotation of the drums, the knives are imparted movements away from and towards one another. Lifters or rocker members are designed to interact with the knives so that a respective lifter can interact alternatively with the respective knife to bring about different shed positions for the heald frames of the weaving machine.

BRIEF SUMMARY OF THE INVENTION

It is possible to make the dobby, which constitutes a module unit in the weaving machine, with great compactness. This is advantageous with regard to exchange and service etc. of the dobby in the weaving machine. However, the principles and the construction employed to achieve the compactness are not to affect durability, service life etc. The invention aims to solve this main problem and is characterized by very small mounting dimensions. In comparison with current dobbies, the size of the new proposed dobby can be reduced by approximately 50% in current weaving machine models. In this regard, reference is made to TEXO TM 300 and TEXO TM 400 weaving machines. The new principle proposed for the arrangement of the catching members, for example, use may be made now of only one driving cam drum instead of the previous two as is the case with the known equipment described above. In this connection, coordinated driving of cam drums is avoided, which increases reliability.

The dobby is a very important machine unit in a weaving machine and it is essential for the weaving result that the dobby functions efficiently. There is thus, for example, a requirement for the greater reliability (reproducibility) and, at the same time, mechanical loads on the dobby components aid the same time permitting frequent changes of the shed positions to be carried out for the heald frames. A further requirement is a high degree of freedom from maintenance. The invention aims to solve these problems in full or in part.

The invention also proposes a warning arrangement which comes into operation in the event of unacceptable functioning. The new dobby can be implemented in machine parks which already exist and can also be incorpoprated in the manufacture of new weaving machines.

A further aim of the invention is that, in spite of the above proposal, relative movements between the hooks of the lifters and of the knife elements can be avoided. Only static loading is acceptable. The invention also solves this problem and reduces wear in the dobby in spite of the compactness.

The new shaft arrangement is mainly characterized in that the mutually interacting catching members (the lifters and the knives) for each treadle are located on the treadle and levers mounted on the treadle spindle. The controlled interaction between catching members brings about interconnection, by means of the catching members, of the treadle with the corresponding lever of the levers which is designated by the control. Lastly, the invention is characterized in that the drive equipment is arranged so that, once interconnection has been established, it acts on the lever interconnected with the treadle, during which motive action the treadle follows the movement of the lever and in turn performs said action on its assigned heald frame via the link arrangement concerned.

In a preferred embodiment, the drive equipment acts on the levers via their catching members which may consist of knife elements). In the preferred embodiment, the number of levers is two. Each lever comprises knives or knife elements which form part of catching members and can, in an intermediate position of the treadle, be interconnected with a lifter (rocker member) arranged on the treadle. In the intermediate position, the lifter is arranged so that, depending on a control, it will enter into interaction with the knife or the knife element on one of the levers. The intermediate position corresponds to a closed shed position of the heald frame in question brought about by the treadle via its associated link arrangement.

The control can be effected by means of one or more operating members, for example one or more pneumatic and/or hydraulic components. In the present case, use is made of a pneumatic double-acting cylinder of a known type known. The component can be controlled by the pattern program of the weaving machine and determines in the case of each current connection whether the heald frame is to be moved to an upper or a lower shed position.

In one embodiment, control members are arranged in order to sense whether the lifter or the lifters on the treadle are situated in an intended desired hooked-up position with a corresponding knife or knife element on the lever in question when the drive equipment moves the lever and its catching member from the central position. The two levers are each assigned its own control member which, in the event of an unacceptable hooking-up function between the lifter and the knife element concerned, can be acted on by the lifter when the lever and the treadle are moved from their central position. Control members can be arranged in order to allow presetting of a new shed position, that is changeover from a knife element on one lever to the knife element on the other lever, before the intermediate position of the levers has been reached. The presetting is effected by the end surface of a control arm running along a curved inner surface on the lifter of the treadle. Each control member can comprise a pivotably arranged control arm which allows passage of the lifter in the case of correct hooking-up between the lifter and the knife in question and is subjected to outward pivoting action from the lifter when the latter is not adequately hooked up to the corresponding knife element. Outward pivoting of the pivoted-out control arm is sensed by a sensor element which indicates the unacceptable hooking-up function. In this way, weaving can be interrupted and the fault rectified at an early stage so that conspicuous faults in the woven material are avoided. Rejection can in this way be reduced.

In a preferred embodiment, the drive equipment comprises a concave cam drum with eccentric curved grooves arranged so as to bring about, during rotation of the drum, upward and outward pivoting movements of the levers from an intermediate position to completely upwardly and outwardly pivoted positions and downward and inward pivoting movements from the latter positions to the central position etc. In the central position, the treadle can be interconnected by means of catching members with either lever depending on the control from the weaving pattern. Arranged on the underside of the catching members/knife elements are low-friction members which can be constituted by roller members. Via the low-friction members, the grooves (groove surfaces) of the cam drum interact with the knives and the levers connected to these so as to bring about the outward and upward pivoting movements and downward and inward pivoting movements respectively. In an embodiment, the treadle is arranged to assume or move its associated link arrangement into or between three positions, comprising an intermediate position corresponding to the central position in which the heald frames assume a closed shed position and two outer positions in which the heald frames assume upper and lower shed positions.

The concave shape of the cam drum is designed to allow the spindle center of the low-friction members/roller members to be parallel to a vertical line. This makes it possible to provide vertical lowerability and raisability for the whole shaft treadle assembly where the low-friction members/roller members can be lowered straight into and raised straight out of the grooves of the cam drum.

In a preferred embodiment, a number of treadles are mounted on the same treadle spindle and are operated by two levers. These levers are provided with knife elements which can interact with the lifters on all the treadles which are mounted on the treadle spindle. One and the same set of driving equipment (cam drum) drives all the treadles mounted on the treadle spindle via common low-friction members or roller members. In the exemplary embodiment, the drum can be driven from the main shaft of the weaving machine in a. Alternatively, the drum can be driven separately, using known drive. The cam drum and its bearing are arranged in an oil bath which guarantees low friction and long service life. In a preferred embodiment, each treadle is provided with a lifter which is mounted on the lower part of the treadle via the central portion of the lifter. In this connection, the lifter has a hooking-up member for the respective knife element on the respective lever arm. The operating member or the hydraulic or pneumatic control component is mounted on the treadle on the lower portion thereof. The component is fastened, for example via its piston, to the lifter to achieve the relative movement between the treadle and the lifter. The piston or the cylinder is fastened close to the bearing point of the lifter.

By virtue of the proposals above, the number of components as far as, for example, the drive equipment is concerned can be reduced in the dobby in spite of the fact that the latter works with rapid functioning intervals. The dobby is very compact by virtue of the fact that a large number of treadles which are arranged on a common treadle spindle can be operated by one and the same drive member in the form of a cam drum. Through the use of low-friction members which transmit the movement from the cam drum to the levers or the knives thereof, wear is significantly reduced. By virtue of the fact that the treadles and the levers/knife elements are mounted on the same spindle, relative movements between the lifters and the knife edges are avoided, which it is generally desirable to achieve. The movements from the treadle to the respective heald frame are distinct and well defined. The principle and the construction of the dobby mean that it can easily be applied to existing functions and construction components (links, bearings etc.) in weaving machine principles and weaving machine constructions which already exist. The warning system also guarantees high-quality woven material in spite of the fact that the pick speed in the weaving machine can be or is selected to be relatively great (for example 40–60 picks/minute).

DETAILED DESCRIPTION OF THE DRAWINGS

Figure 1:
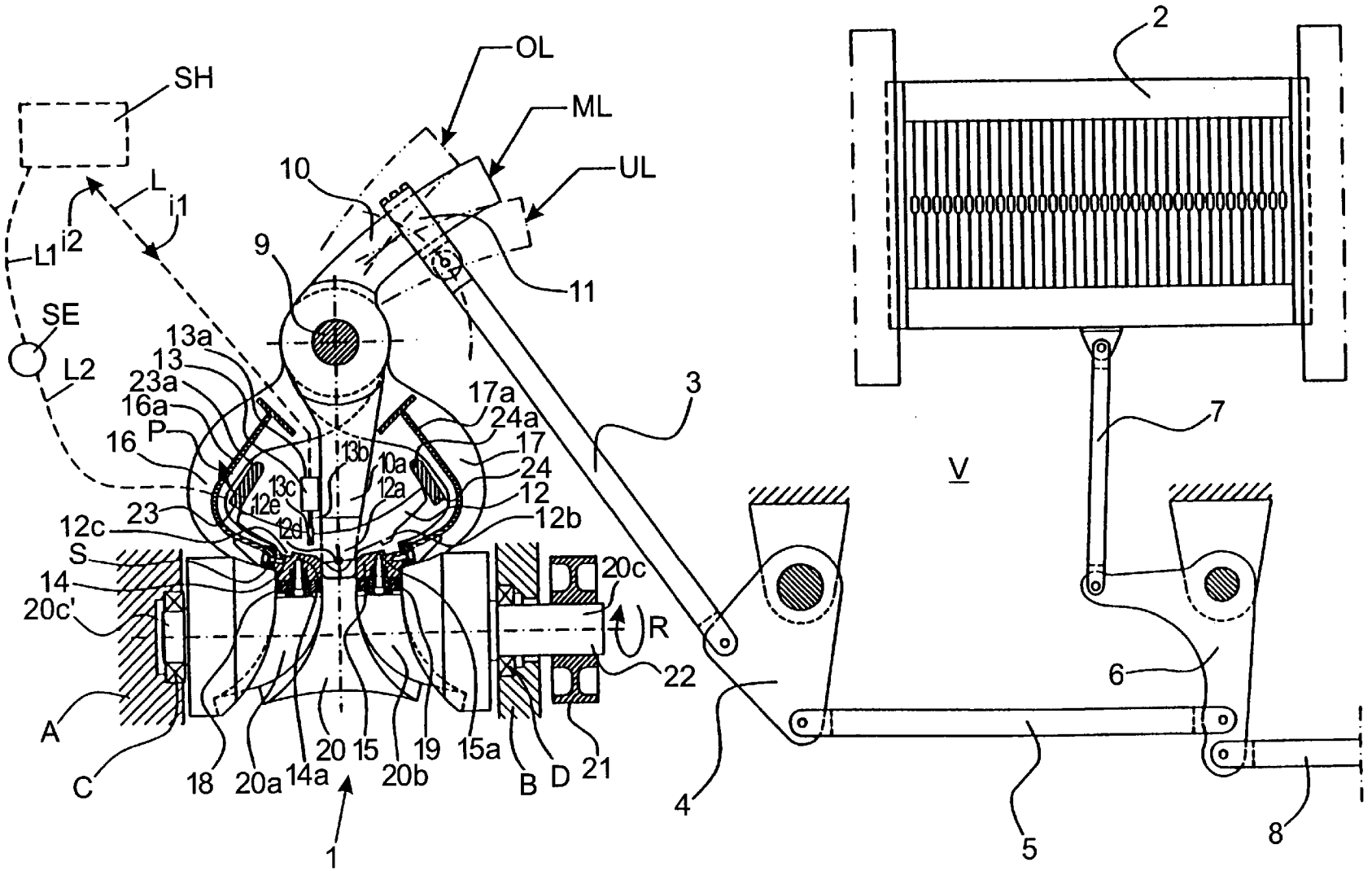
Figure 2:
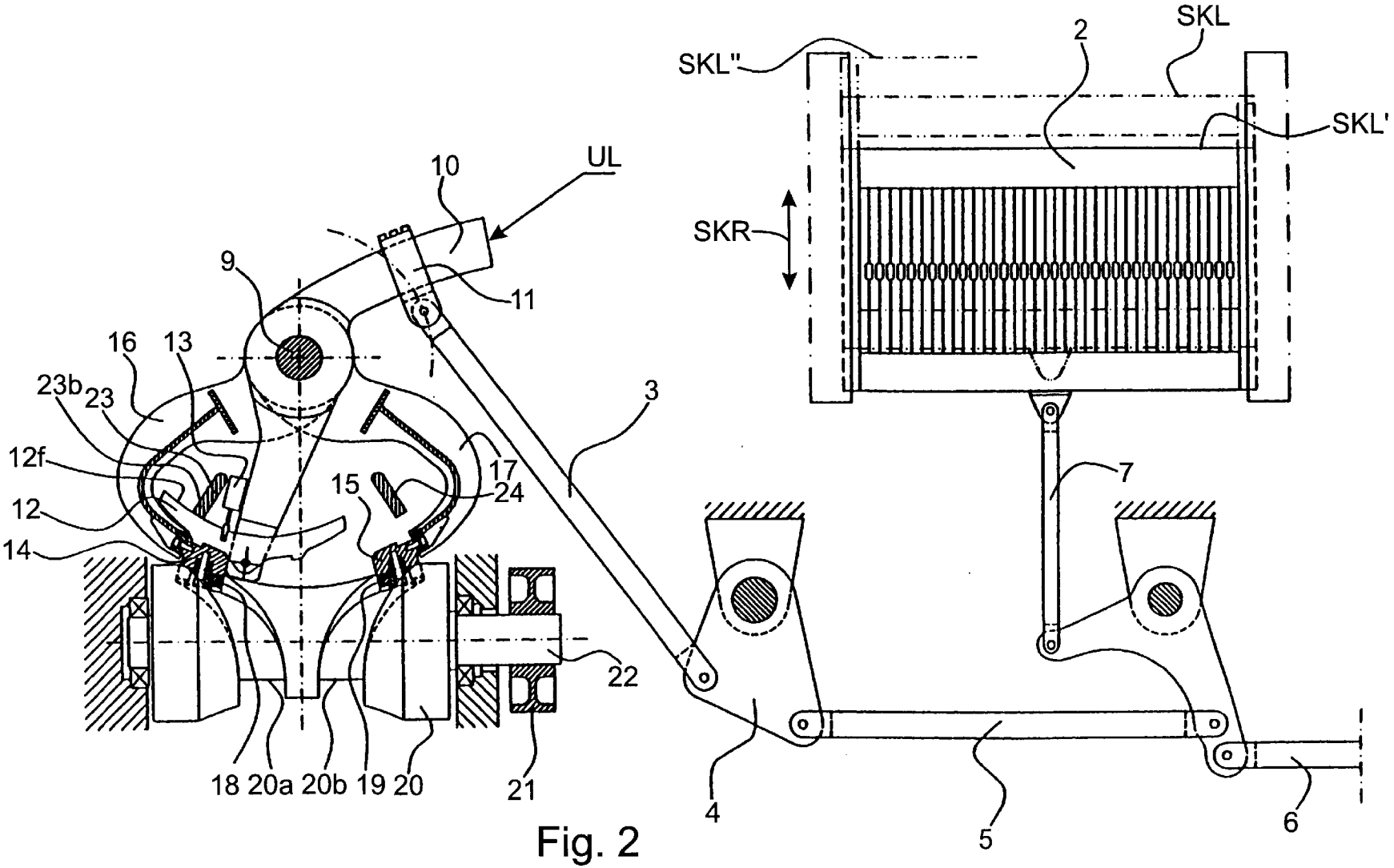
Figure 3:
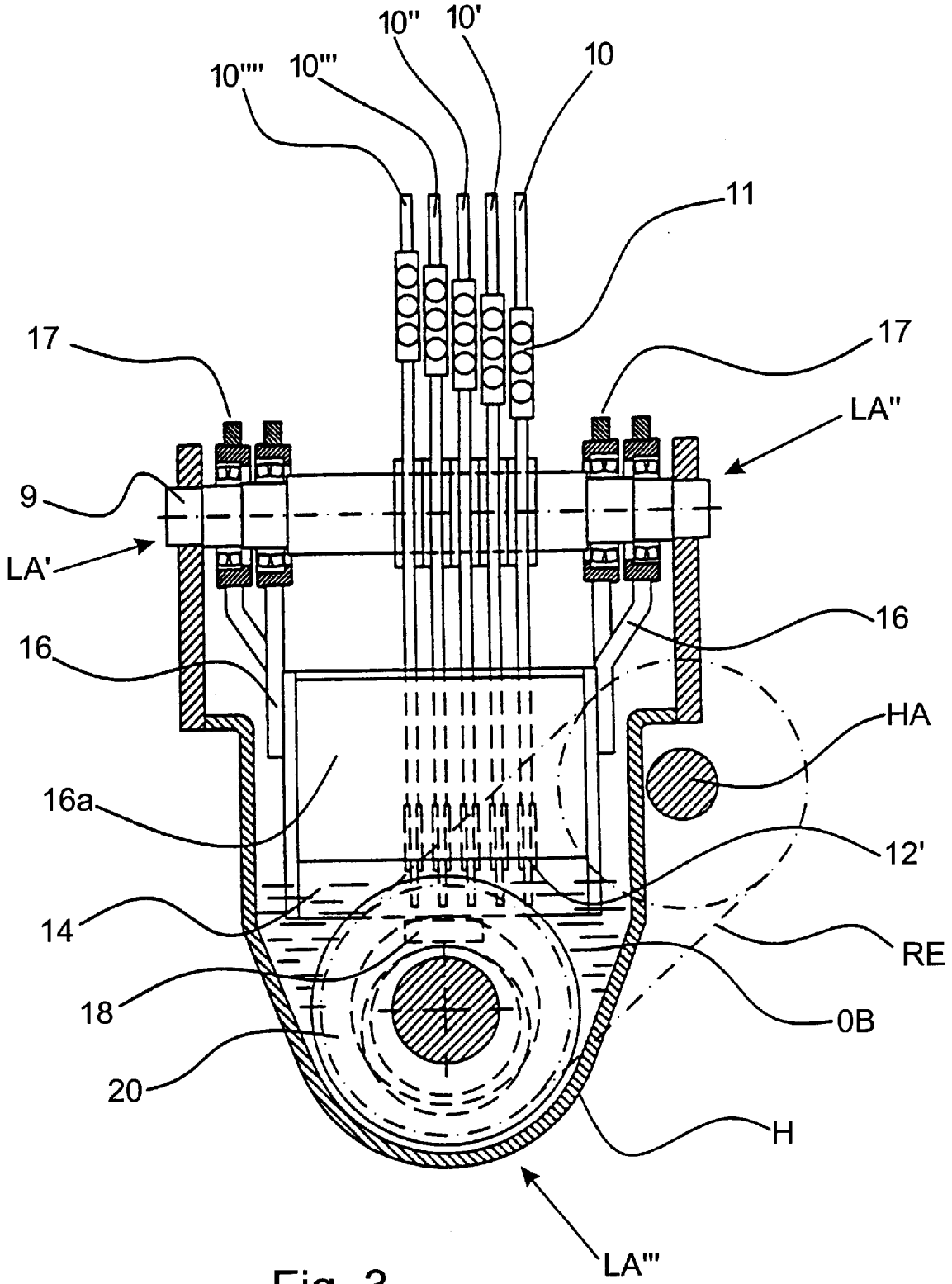
Figure 4:
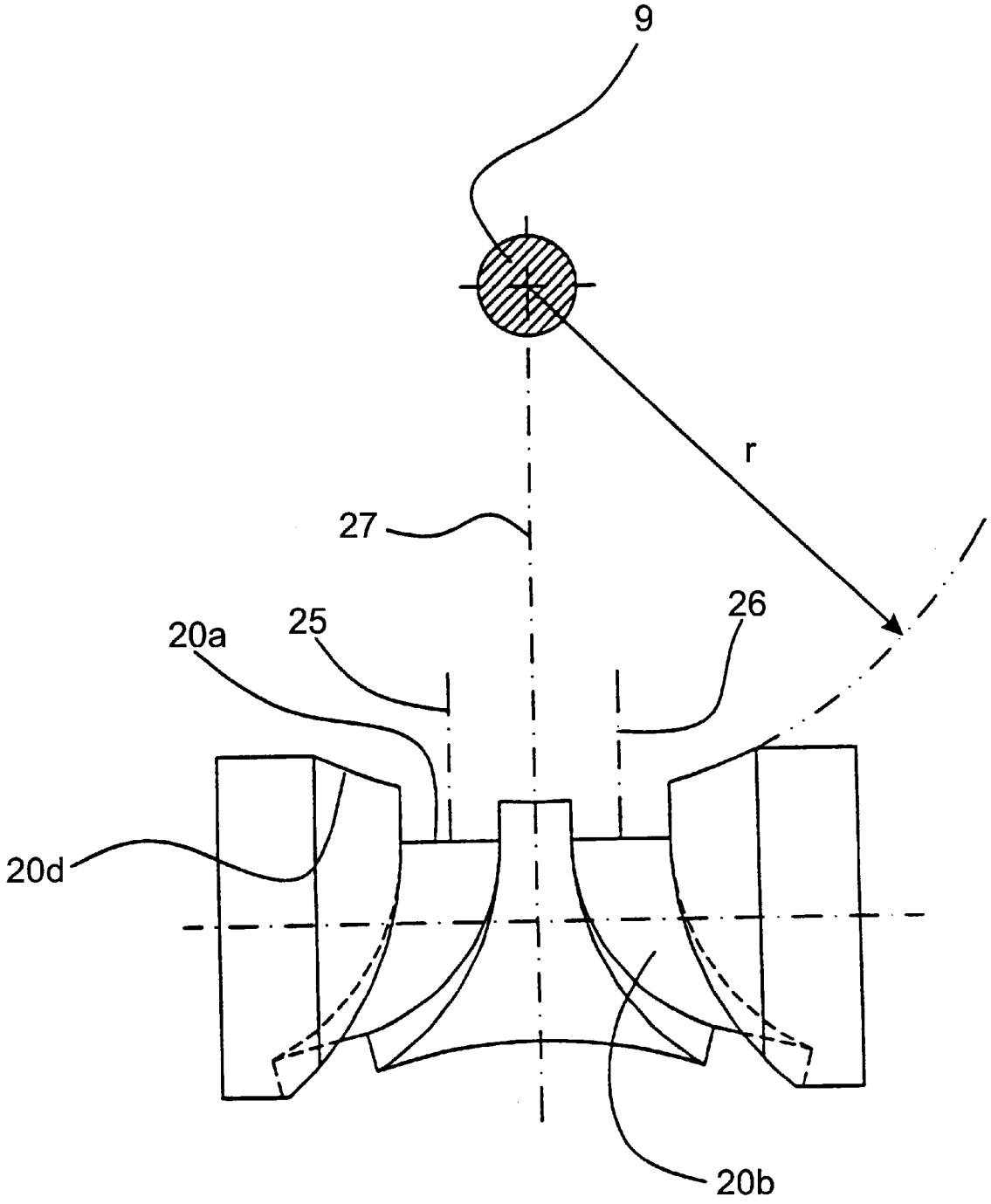

A proposed embodiment of a dobby which has the significant characteristics of the invention will be described in greater detail below with simultaneous reference to the attached drawings, in which FIG. 1 shows partly in cross-section the bearing arrangement of a treadle and levers operating it, where the treadle and the levers are provided with lifters or knives respectively and where drive equipment in the form of a cam drum is arranged to carry out driving of the levers and the treadle, in addition to which the figure also shows a heald frame which forms part of the weaving machine and can be acted on by the treadle via a link arrangement, FIG. 2 shows the arrangement according to FIG. 1 in vertical section but in a different functioning position, FIG. 3 shows in vertical section, turned through 90° in relation to the sections according to FIGS. 1 and 2, a number of treadles mounted on a common treadle spindle, where the treadles are operated by two levers and one set of driving equipment (cam drum), FIG. 4 shows a view from the front of the cam drum according to FIGS. 1–3, where the concavity of the cam drum has been shown in relation to the treadle spindle, and FIGS. 5–9 show various views and diagrams of a second embodiment.

DETAILED DESCRIPTION OF THE PREFFERED EMBODIMENT

FIG. 1 shows an overall view of the whole drive system from a dobby 1 to a heald frame 2 arranged in a weaving machine V, to which the dobby 1 is connected. In order to simplify the description of the invention, only parts of the weaving machine V which are involved have been shown. From the dobby 1, a connecting rod 3 leads to a lever 4 which is also interconnected with another connecting rod 5. At its other end, this connecting rod is interconnected with an angle lever 6 which is also connected to the heald frame rod 7. Along the entire working width on the weaving machine V, there is a number of angle levers 6 which are interconnected with a common connecting rod 8 which has the function of in a known manner commonly raising and lowering the entire heald frame assembly. The dobby 1 is constructed as a compact unit which includes all the necessary functions for the heald frame 2. These components and functions described are well known and will not be described further here. A treadle spindle 9 is arranged to support a number of shaft treadles 10. The number in an embodiment (on TEXO weaving machines) can be 17, 20 or 24 shaft treadles. At the upper end of each shaft treadle, there is a holder 11 for the connecting rod 3. This holder is adjustable so as to produce different sizes of shed opening in the heald frame depending on whether it is first or last shafts which are to be considered. At the lower end of every shaft treadle, a shaft lifter 12 is rotatably mounted. The lower part of the treadle is indicated by 10*a*. The lifter is mounted on the lower part 10*a* at its central portion 12*a*. The lifter has two hooks 12*b* and 12*c* which are located on either side of the bearing spindle 12*d* of the lifter in the treadle. The shaft lifter 12 is actuated by means of an operating member in the form of a double-acting pneumatic cylinder 13 which, via its cylinder part 13*a*, is fastened on a surface on the treadle on the lower part 10*a*. The piston 13*b* of the cylinder is fastened to the lifter on one side of the bearing spindle 12*d*. The fastening point or fastening arrangement is shown by 13*c*. The cylinder 13 is controlled from a control unit SH in the weaving machine V. This control unit is of a known type and the connection of the cylinder (the operating member) to the power source (compressed-air source, hydraulic-oil source, electric-power source) and the control valve circuits (control circuits) can be made in a known manner. FIG. 1 shows a connection L from the control unit to the operating member or to the control valve circuit of the cylinder. The control unit circuit comprises in a known manner the pattern program of the weaving machine which at any given moment of control determines whether the heald frame 2 is to go to the upper or lower shed position (see also below), FIG. 1 shows the functional stage in which the dobby initiates the closed shed position of the heald frame 2. In this case, the treadle 10 assumes a central position shown in FIG. 1, which is the position when it is possible for the lifter 12 to change position. In the figure, the lifter has been connected to a lower knife 14 which has a hook 14*a* which can interact with the hook 12*c* on the lifter. On the other side of the bearing spindle 12*d*, the hook 12*b* of the lifter is free from an upper knife 15, that is to from a hook 15*a* of this upper knife, which can interact with the hook 12*b* of the lifter in a corresponding manner to that in which the hook 14*a* can interact with the hook 12*c* on the lifter when the latter assumes its other rocker position. The two shaft knives 14 and 15 are screwed tightly into or otherwise connected to the levers 16 and 17 respectively which are mounted on the treadle spindle 9. The knives are connected to, for example screwed tightly into, the ends of the levers with the aid of screwing members S. The levers have two end-wall parts which extend in the plane of the FIG. 1. Only one end-wall part is shown in FIG. 1. The end-wall parts of each lever are held together by side-wall parts 16*a* and 17*a* respectively which have a considerably smaller extent in the plane of the FIG. 1 in comparison with the end-wall parts. The wall parts 16*a* and 17*a* thus extend at right angles to the plane of the figure (see also FIG. 3 according to the description below). The levers 16 and 17 respectively are acted on via the undersides of the shaft knives 14 and 15 by means of cam rollers 18 and 19. These cam rollers are driven from a cam drum 20 provided with grooves, the groove for the cam roller 18 being indicated by 20*a* and the groove for the cam roller 19 being indicated by 20*b*. The grooves are arranged eccentrically on the cam drum and are moreover curved so that, during rotation, the cam drum can impart to the knives 14, 15, and the levers 16, 17 connected thereto, upwardly and outwardly directed movements in relation to the central position shown in FIG. 1. The fully pivoted-up upwardly and outwardly directed positions are shown in FIG. 2. From these fully upwardly and outwardly directed positions, the shape of the cam drum causes the levers with the associated knife edges to pivot back downwardly and inwardly, during the continued rotation of the drum, to the central position shown in FIG. 1. The movements of the knife edges and the levers are thus brought about by the rotation of the cam drum in one and the same chosen direction of rotation R which may be the clockwise direction. The cam drum is driven synchronously or asynchronously from the main shaft of the weaving machine by means of a toothed belt which is wrapped around a belt wheel 21 in a known manner. The belt wheel 21 is fastened to the shaft 20*c* of the cam drum. The cam drum is mounted in bearing parts A and B in roller bearings C and D respectively. It is also possible to arrange the drive shown in another manner, for example with chain-wheel or toothed-wheel drive of a type known per se. In an alternative embodiment, the cam drum can be driven by a separate drive arrangement, that is independently of the main shaft of the weaving machine.

In the dobby, there is also provided an arrangement which controls and monitors the pattern change. This arrangement consists of two pivotable control arms, namely a control arm 23 for the lower knife 14 and a control arm 24 for the upper knife 15. In the closed shed position (which corresponds to the central position according to FIG. 1), the distance between the control arms 23 and 24 is such that the lifter 12 can be pivoted freely over from one shaft knife to the other. If for any reason the lifter should not be hooked up correctly to the shaft knife 14 or 15, the outermost tip 12*e* of the lifter will run against the control arm in question, in this case against the control arm 23, which causes the latter to pivot out in the direction of the arrow P (around a bearing) by virtue of the fact that it is pivotably mounted at its end 23*a* (24*a* respectively). On the outside of the dobby, there are sensors SE which sense the position of the respective control arm and, as soon as the latter assumes a position which is pivoted out from the position according to FIG. 1, the weaving machine is stopped. Only the sensor SE for one control arm 23 has been shown in the figure. The other control arm 24 has a corresponding arrangement. The sensor can be of a known type. In FIG. 1, the sensor has been shown in a removed position at a distance from the control arm 23 for the sake of clarity. The sensor is connected to the control unit SH or another unit in the weaving machine. The electric wire between the sensor and the control unit has been indicated by L1. The function of the sensor of sensing the position of the control arm 23 has been indicated by L2. The stop function can work in a known manner.

By means of the arrangement shown in FIG. 1, the treadle 10 can thus, via its lower part where the lifter 12 is arranged, be hooked up to the lever 16 or 17 which is determined by the operating member or control member 13. The control signal for a respective setting has been indicated by i1. Setting for the lower or upper knife 14 or 15 respectively is thus determined by the control signal i1 when the treadle and the levers/knives assume the central position shown in FIG. 1. Depending on which interconnection is effected, the treadle is rotated from the central position ML which is shown by solid lines in FIG. 1 to either the lower shed position UL or the upper shed position OL which have been shown by dot/dash lines. The treadle will thus move the heald frame 2 to its lower shed position or upper shed position respectively via the link arrangement 3, 4, 5, 6, 7.

In FIG. 2, the cam drum has assumed a rotated position which results in the treadle 10 having been able to assume one of the outer positions UL, OL, in this case the outer position or upper shed position OL or lower shed position UL respectively by virtue of the control component 13 having acted on the lifter 12 in interaction with the lower knife 14. The arrangement shown is also advantageous because rapid changing from the lower shed position to the upper shed position and vice versa can take place. This function is brought about with the aid of either control arm 23 or 24. If the case according to FIG. 2 is considered, it is possible, in the fully upwardly and outwardly pivoted position of the levers/knives, to begin repatterning for the next pattern change if the same is to take place in the closed shed position. In the case shown, the cylinder 13 (the operating member) is acted on by means of the control i1 (see FIG. 1) to function in a pushing manner which causes the lifter 12 to be pushed down towards the lower knife 14. In the position shown in FIG. 2, the cylinder can already be acted on to assume the pulling position (see the control signal i2 in FIG. 1). Although the cylinder in this case assumes the pulling position, the lifter is prevented from leaving its position of interaction with the lower knife 14 by the upper surface 12*f* of the lifter interacting with the end surface 23*b* of the control arm. Only when the lever 16/lower knife 14 has reached the central position according to FIG. 1, is the lifter released from the end surface of the control arm and can the reversal initiated by the operating member or the cylinder in the position according to FIG. 2 be effected. With this function, the change-over functions between the upper and lower positions are speeded up, which contributes to functional changes in the machine being faster. The actuation time for lifter change-over is thus minimal. The heald frame positions are indicated by SKL, which corresponds to the closed shed position, and SKL', which corresponds to the lower shed position, and SKL", which corresponds to the upper shed position. The heald frame movements are symbolized by the arrows SKR.

FIG. 3 shows an end view of the dobby, in which a number of treadles 10, 10', 10", 10'", 10"" etc. have been indicated. All the treadles are operated by one and the same cam drum 20 which drives the shaft knives/levers 16, 17 in accordance with the above. The cam drum is arranged in a casing H or trough, in which the cam drum is situated in an oil bath OB. The cam rollers 18, 19 are also situated in the oil bath. The lifter on a treadle is shown by 12' and interacts with knife arrangements 14 and 15 respectively which are common to all the treadles. The number of treadles can thus be selected arbitrarily so as to be operated by the same cam drum 20 and knife arrangement 14 and 15 respectively. In FIG. 3, the main shaft of the weaving machine is indicated by HA and the belt arrangement by RE. The bearings LA', LA", LA'" are sealed and lubricated for long service life, which, together with the fact that the cam drum runs in an oil bath, means that the dobby requires a minimum amount of maintenance.

FIG. 4 shows the shape of the concave cam drum where it can be seen that the concave part has a radius r which is related to or has as its point of origin the treadle spindle 9. A very great advantage of this shape of the drum is that, in the closed shed position, it allows the spindle centers 25 and 26 of the cam rollers 18 and 19 (see above) to be parallel to a vertical line 27 which intersects the center of the treadle spindle 9. Thus it is simple to lower and raise the whole shaft treadle assembly so that the cam rollers go directly into the grooves 20*a*, 20*b* on the cam drum or can, respectively, be raised from the grooves. The cam drum can be made in one or more parts.

Figure 5:
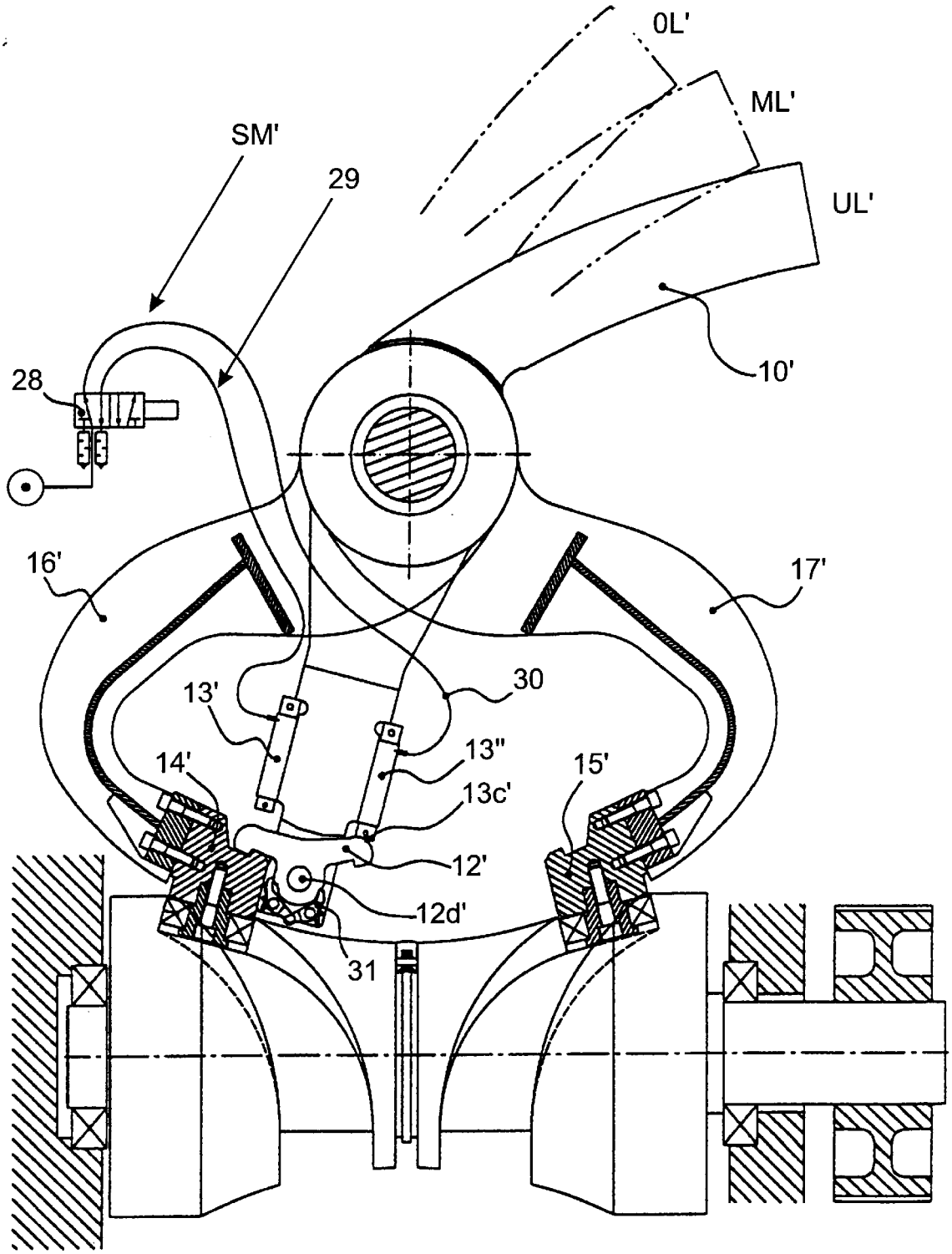

In an embodiment according to FIG. 5, two control members 13' and 13" are included, which, depending on the pattern program, control the change-over position of the lifter 12' in the central position ML' (see FIG. 1) of the levers 16', 17'. The control members 13', 13" each act in one rocking movement direction of the lifter 12'. The control members 13', 13" can be actuated one at a time. The control members consist of pneumatic cylinders and/or hydraulic cylinders controlled by means of an electrically operated valve 28 which, in a control-dependent manner, controls the direction of the oil flow through the cylinders in a manner known manner. The pipes are indicated by 29, 30. In FIG. 5, the lifter 12' and the lower knife 14' are interacting. The upper knife 15' is free from the lifter. During the raising or lowering movement, shown in FIG. 5, of the arms 16', 17' from or, respectively, towards the central position ML', the member (the cylinder) 13" can, with its piston rod (which can be rectangular) 13*c*', act on the lifter from above and in so doing seek to make the lifter come out of its catching position. The lifter is nevertheless securely retained in its position of interaction with the lower knife with the aid of a locking member 31 as described below. By virtue of the locking function, the next rocker position of the lifter can be preset before the levers reach the central position. As a result, time can be saved in comparison with the case where the setting function can be carried out only after the central position has been reached. The lifter can rock around its bearing 12*d*'. The upper shed position of the treadle is shown by OL'.

Figure 6:
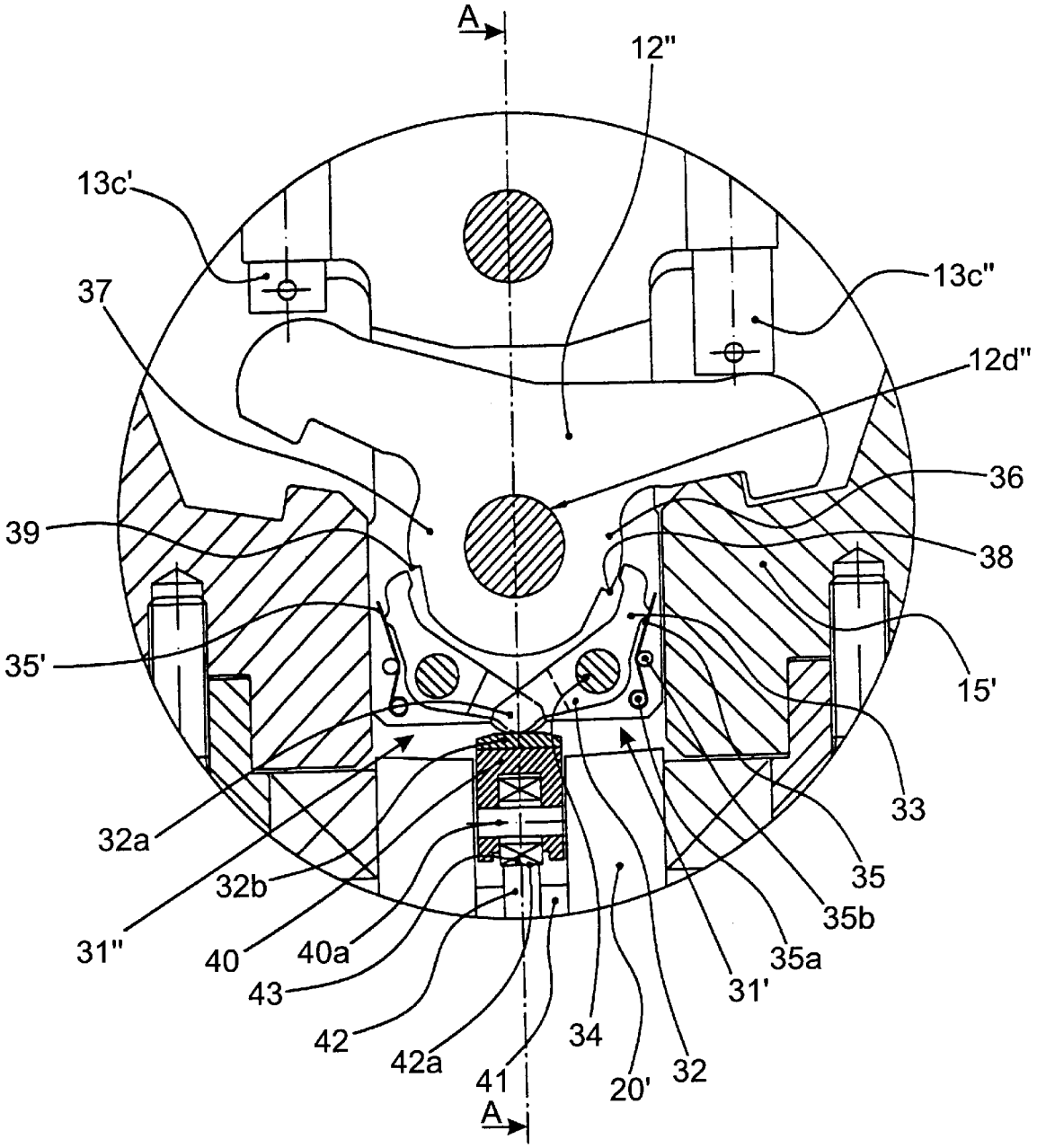

FIG. 6 shows two locking or hooking-up members 31', 31". Each member consists see a rocker member with two mutually angled parts 32, 33 and is arranged in a rocking manner on or about a spindle 34. Each rocker member can be acted on by a return member, preferably in the form of a spring which may consist of a leaf spring 35, which presses the part 33 against the outer contour 36 of a bearing part 37 on the lifter. The leaf spring is mounted at one 35*a* of its ends and is supported in its central parts by a stop member so as to ensure adequate resilience. The outer contour 36 has two recesses, heels or other members 38, 39. Each rocker member can be acted on via its other end by a preferably beam-shaped member 40 arranged above a driving cam on the cam drum 20'. The cam drum has a recess 41 and the cam, which is designated by 42, is arranged in the bottom of the recess. The preferably beam-shaped member has an actuating part in the form of a wheel, a cam roller or a trundle via which the interaction with the driving cam takes place. The beam-shaped member is mounted partly in the recess 41 and can perform vertical movements therein brought about by the driving cam 42 and return members described below. The wheel or the trundle 43 is mounted on a spindle 40*a* in the preferably beam-shaped member. The beam-shaped member interacts with the ends 32*a* of the rocker members via a wear-resistant protective layer 32*b* on the upper side, which protective layer is resistant to frictional movements.

In FIG. 6, the presetting effected by means of the piston rod 13*c*" has been released, which has resulted in the lifter 12" changing over from the catching position with the lower knife to the catching position with the upper knife. In so doing, the upper knife and the relevant hook on the lifter have entered into engagement.

The beam-shaped member assumes the position, shown in FIG. 6, above the relevant surface 42*a* of the cam drum. In this position, the parts 33 are moved out of their positions of interaction with the outer contour 36 of the lifter, or rather out of their interaction with the recesses or heels 38, 39.

The cross-beam 40 has been lowered and the rocker member 31" has been engaged in the heel/recess 39 before the outward movement by the upper and lower knife begins (see FIGS. 8 and 9 described below).

When the levers pivot up from the position shown in FIG. 6 and the upper knife drives the treadle, rocker members 31' and 31" are no longer acted on by the beam-shaped member 40, the result of which is that the rocker member 31" can be brought into contact with the recess or the heel 39 with the aid of its associated return member 35'. The piston 13*c*' on the member 13' (FIG. 5) can then, as described above, be preset with the aid of the pattern program, that is to say it can act on the lifter to change position before the levers have reached the central position. The rocker member 31" prevents the change taking place before the central position is reached.

The double driving cam (see 20*a*, 20*b* in FIG. 1), as described above, on the cam drum returns all the shaft treadles to rest or central positions which can lie within a range of rotation of the cam drum of 20° of the relevant cross-section of the cam drum. Within this range, use is made of the cam function 42 with the beam-shaped member 40 for disengaging the locks or rocker members 31', 31". The various lifters on all the shaft treadles can then be set according to the pattern and accordingly interact with the upper and lower knives of the various shaft treadles. The disengaging beam 40 runs across the entire shaft treadle assembly and, with its vertical movements, acts on all the locks, that is to say two per treadle, and frees the lifters for connection to the upper and lower knives. As the movement of the driving cam continues, the disengaging beam 40 will subsequently be lowered, with the result that the locks concerned are able to enter the relevant recesses 38 and 39 of the lifters and prevent connection to the knives which are not to be engaged in the current stage. The respective other lock is disengaged and bears against the relevant outer contour of the lifter without engaging any recess or heel. As soon as the driving cam has come out of the rest position, the lifter is locked against opposite movement by means of the actuated locking member and it is then possible to prepare the repatterning as described above. By means of the above, change-over of the lifter can be carried out by means of the cam 42 and in this way the treadle remains completely stationary. Positive locking of the lifter is achieved by lock and hook. Lifter change-over can be carried out with the treadle stationary, which makes possible minimum clearance (0.5–2.0 mm) between the lifter and the respective knife during each change-over.

Figure 7:
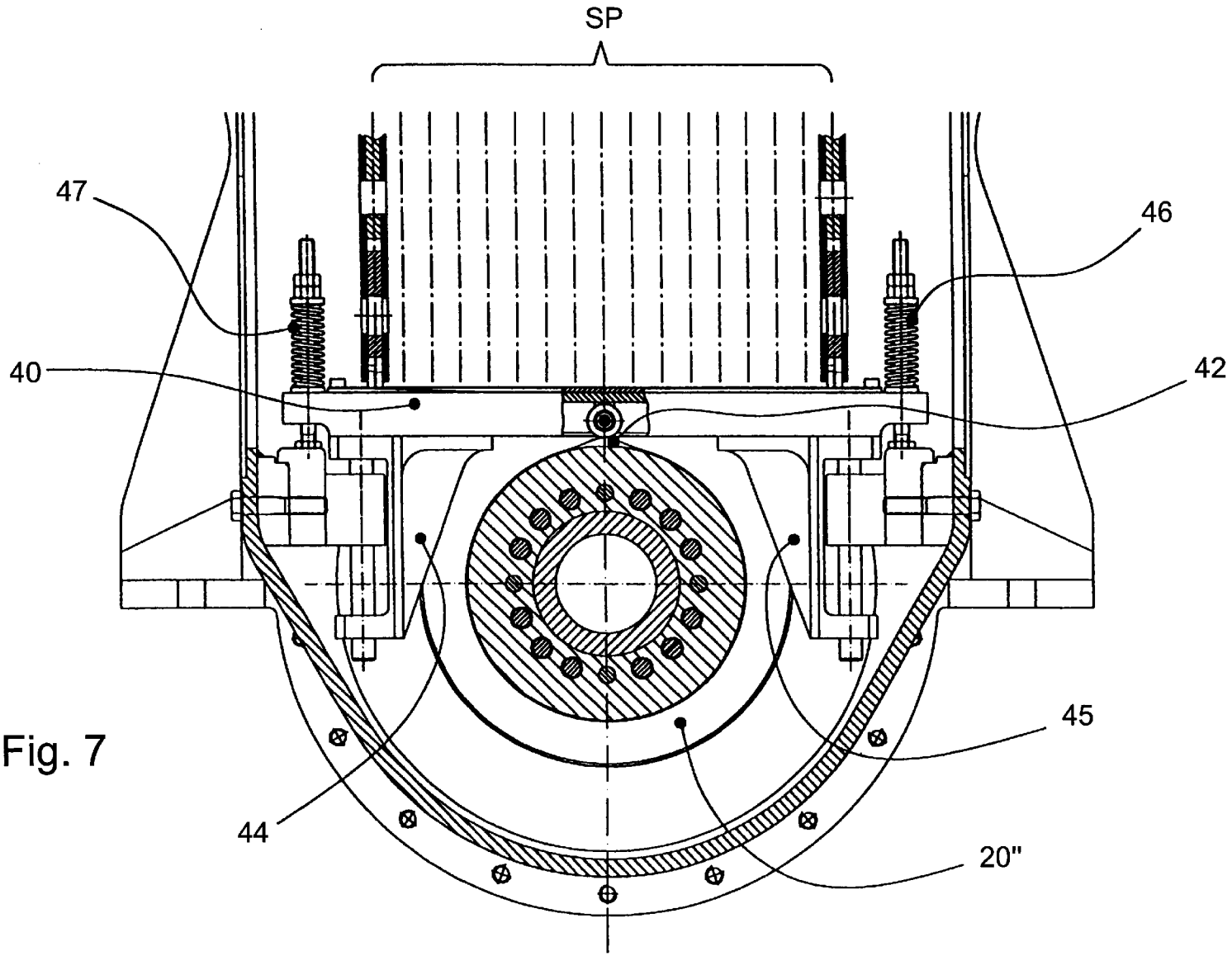

FIG. 7 shows a cross-section through the central cam 42 of the driving cam, which cam 42 is intended for movements which free the lifters. In the position according to FIG. 7, the cam 42 is situated in its highest position and it has raised the disengaging beam 40 to its upper position. In this position of the disengaging beam 40, all the locks (17×2 in the exemplary embodiment) are acted on as described above and all the lifters have been allowed to assume their new pattern positions. The shaft treadle assembly with 17 treadles is shown by SP.

The cross-beam 40 which extends across the cam drum 20" is, on both sides of the centre line of the driving cam 42, mounted in a guide system 44, 45 so as to make possible vertical parallel displacement movements of the cross-beam, that is to upwardly and downwardly directed horizontal movements. The upward movement is effected by the cam 42 counter to the action of spring members, for example compression springs 46, 47, which bring about the downward movement of the beam when the cam 42 comes out of raising interaction with the beam 40. The functioning and construction of other components shown in FIG. 7 emerge from the context shown in FIG. 7 and will therefore not be described here.

Figure 8:
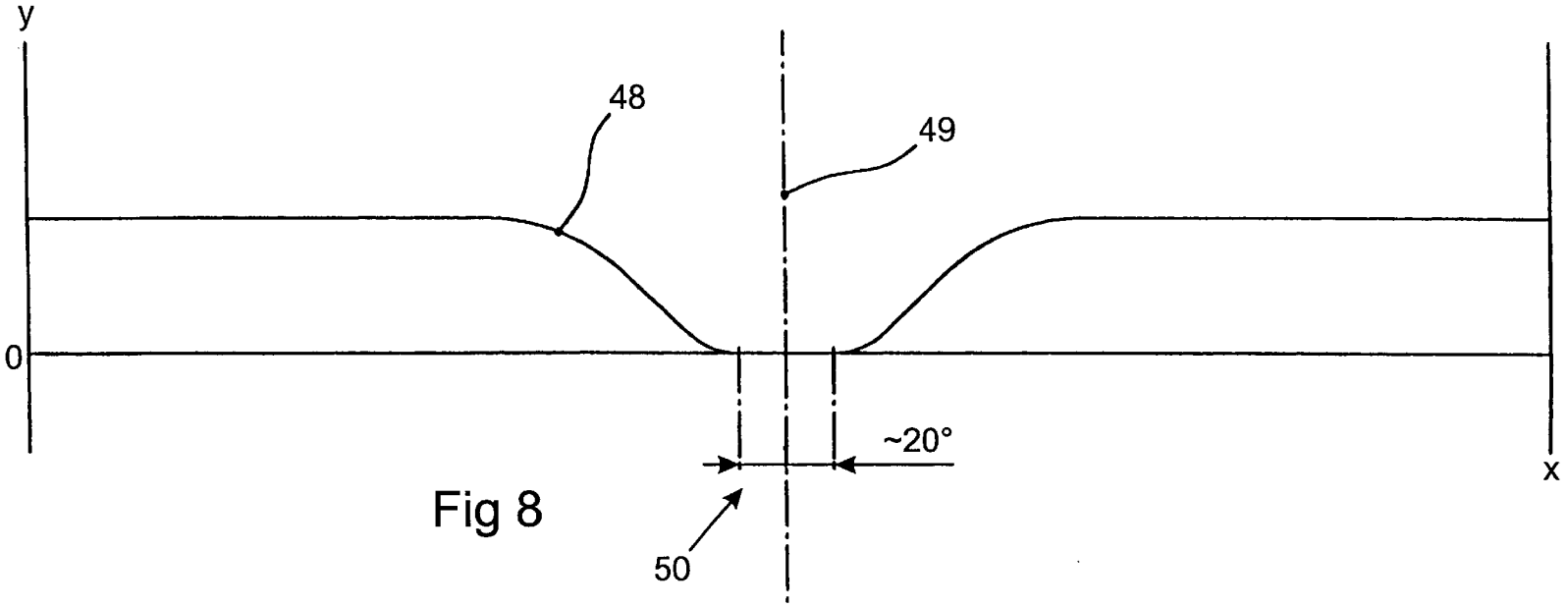
Figure 9:
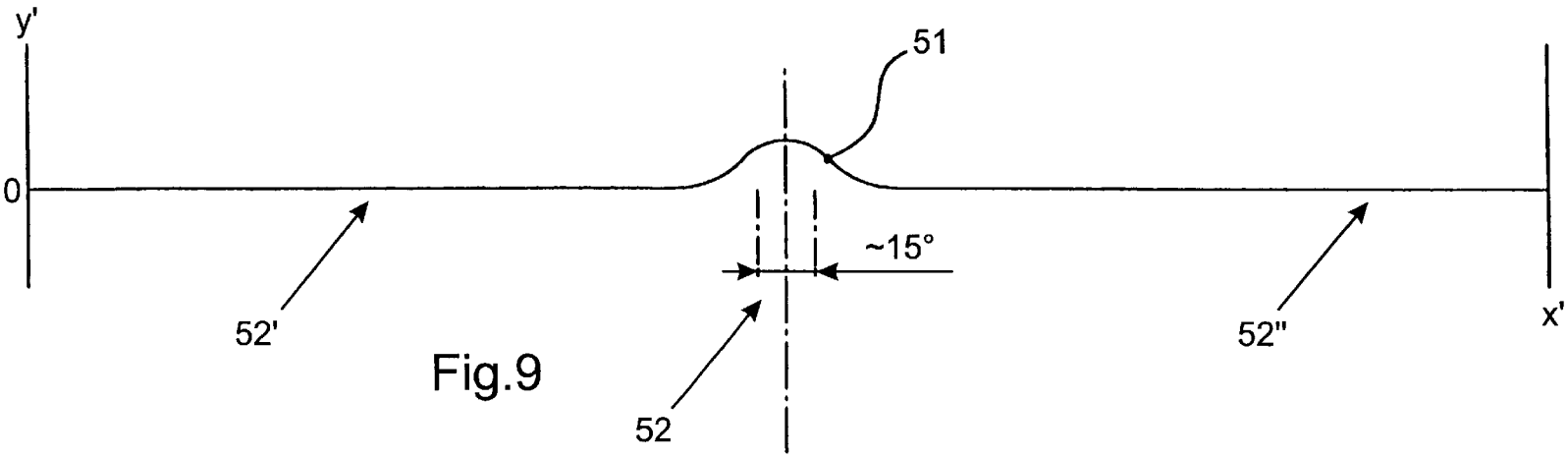

FIGS. 8 and 9 show the functions of the driving cams 20*a*, 20*b*, and 42 respectively, acting on the levers (the knives), and the locks respectively.

The y, y' axes in the diagrams show the magnitudes in millimeters of the action of the respective cam. The x, x' axes indicate the rotary angle positions of the cams in degrees. The curve 48 shows the position 49 for a closed shed where there is no action on the levers/knives from the driving cam 20*a*, 20*b* (see FIG. 1). 50 indicates a range in the closed shed position where the treadles are essentially stationary. The range has in this case been chosen to be roughly 20°. The curve 51 represents the action of the disengaging cam in the closed shed position where, as described above, the lifters can change over. A disengagement range is shown by 52 and is of the order of magnitude of roughly 15 degrees, which range 52 is located concentrically in relation to the range 50 in the closed shed position. Ranges (=first rotary angle positions) next to the range 52 (=second rotary angle positions) are indicated by 52', 52".

The invention is not limited to the embodiment shown above by way of example but can be modified within the scope of the following patent claims and the inventive idea.

I claim:

1. A dobby for controlling movements of a heald frame in a weaving machine comprising:

a treadle mounted on a treadle spindle;

a link arrangement connecting said treadle to said heald frame;

levers mounted on said treadle spindle;

catching members arranged on said treadle and on said levers, said catching members on said treadle interacting with a corresponding catching member on one of said levers based on a control signal;

drive equipment arranged to move said levers between a central position and an outer position, whereby said treadle follows the movement of said levers and moves said heald frame via said link arrangement.

2. A dobby according to claim 1, wherein said drive equipment moves said levers via said catching members on said levers.

3. A dobby according to claim 1, wherein there are two levers and said catching members arranged on said treadle comprise a lifter and said catching members arranged on said levers comprise a knife element arranged on each of said levers, said treadle having an intermediate position, corresponding to a closed shed position of said heald frame and to said central position of said levers, in which said lifter interacts with one of said knife elements based on said control signal.

4. A dobby according to claim 3, further comprising an operating member controlling said lifter to interact with either one of said knife elements based on said control signal received from a control unit.

5. A dobby according to claim 4, further comprising locking members arranged to lock said lifter in place against said knife elements.

6. A dobby according to claim 5, wherein said locking members comprises:

rocker members and a spring member corresponding to each rocker member, said spring member presses said rocker member against an outer contour of said lifter to lock said lifter in place, said rocker member being movable against the force of said spring member via a cam control to unlock said lifter.

7. A dobby according to claim 5, wherein said lifter comprises a central bearing part, having said outer contour, attached to said treadle via a rocking spindle and two portions projecting from said central part on either side of said bearing part, a hook element being arranged on each said portions, each of said recesses being arranged on said outer contour on opposite sides of said rocking spindle.

8. A dobby according to claim 6, wherein there are two rocker members for each treadle, each rocker member interacting with a corresponding recess on said outer contour of said lifter, when said cam control is in a first rotary angle position one of said rocker members engages its corresponding recess to lock said lifter in connection with said knife element, whereby said lifter can be acted on by said operating member and not moved.

9. A dobby according to claim 8, wherein each said rocker member comprise a first angled part which cooperates with said recess and a second angled part which cooperates with said cam control, when said cam control is in a second rotary position, it acts on said second angled part whereby said first angled part is moved against the force of said spring member and disengages said recess and when said cam control is in said first rotary position said spring element forces said first angled part against said outer contour of said lifter.

10. A dobby according to claim 9 wherein only one of said first angled parts interacts with its corresponding recess at a time.

11. A dobby according to claim 9 wherein said cam control comprises a vertically displaceable member, when said cam control is in said first rotary position said vertically displaceable member projects upward and acts on said rocking members.

12. A dobby according to claim 11 wherein said vertically displaceable member is mounted at its ends in a guide system in said cam drum and further comprising return members which move said vertically displaceable member downward when said cam control reaches said first rotary position.

13. A dobby according to claim 11 wherein said vertically displaceable member extends across said cam drum and operates on a plurality of treadles.

14. A dobby according to claim 12 wherein said second rotary angle has a range of approximately 20 degrees and a disengagement range for disengaging said knife elements from said lifter is approximately 15 degrees.

15. A dobby according to claim 6, wherein said cam function interacts with said rocker members when said levers are in said central position.

16. A dobby according to claim 3, further comprising a sensor for determining whether said lifter is properly connected with the desired knife element when said drive equipment moves said lever from said central position.

17. A dobby according to claim 3, wherein a sensor is provided for each lever.

18. A dobby according to claim 17, wherein said sensor comprises a control arm pivotably mounted on said weaving machine, said control arm arranged to allow passage of said lifter when said levers move from their central position and a complete connection between said lifter and said knife element is made and to be pivoted outward by said lifter when a complete connection is not made.

19. A dobby according to claim 18, further comprising a second sensor producing a stop signal for said weaving machine when it senses the outward pivoting of said control arm.

20. A dobby according to claim 18, wherein a curved inner surface is provided on said lifter to interact with an end surface of said control arm when a complete connection is made between said lifter and said knife element and when said levers have moved from said central position, said end surface preventing said lifter from disengaging said knife element.

21. A dobby according to claim 3, wherein said drive equipment comprises a concave cam drum with eccentric curved grooves, said grooves interacting with said knife elements so that as said drum rotates said levers are moved from said central position upwardly and outwardly from each other to said outer positions and then back to said central position.

22. A dobby according to claim 21, further comprising roller members attached to said knife elements via which said knife elements interact with said grooves.

23. A dobby according to claim 22, wherein said concave cam drum is curved such that a spindle center of said roller members is parallel to a vertical line through the center section of said treadle spindle, whereby said roller members can be raised and lowered straight into and out of said grooves.

24. A dobby according to claim 22, wherein a plurality of treadles each with corresponding lifters are mounted on the same treadle spindle, said knife elements common to and interacting with said lifters on each of treadles.

25. A dobby according to claim 24 wherein one set of drive equipment drives all of said treadles via common roller members.

26. A dobby according to claim 3, wherein said treadle moves said link arrangement and with it said heald frame between three positions, an intermediate position corresponding to said central position and a closed position of said heald frame and first and second outer positions in which said heald frame is in upper and lower shed positions, respectively.

27. A dobby according to claim 1, wherein said drive equipment is driven by a main shaft of said weaving machine and is arranged in an oil bath.

28. A dobby according to claim 3, wherein said lifter is connected at its central part to a lower part of said treadle by a bearing spindle, and hook elements are provided on said lifter on both sides of said central part to interact with said knife elements.

* * * * *